US007097246B2

(12) United States Patent
Sedlatschek et al.

(10) Patent No.: US 7,097,246 B2
(45) Date of Patent: Aug. 29, 2006

(54) SEAT BACK WITH ADJUSTABLE HEADREST

(75) Inventors: Peter Sedlatschek, Plettenberg (DE); Martin Wolowski, Wetter (DE); Martin Kristen, Gelsenkirchen (DE)

(73) Assignee: Stanzwerk Wetter Sichelschmidt GmbH & Co. KG, Wetter (DE)

( * ) Notice: Subject to any disclaimer, the term of this patent is extended or adjusted under 35 U.S.C. 154(b) by 0 days.

(21) Appl. No.: 10/785,927

(22) Filed: Feb. 24, 2004

(65) Prior Publication Data

US 2004/0195895 A1 Oct. 7, 2004

(30) Foreign Application Priority Data

Feb. 25, 2003 (DE) ..... 203 02 994 U

(51) Int. Cl.
*A47C 7/14* (2006.01)
*A47C 7/36* (2006.01)
*A47C 7/38* (2006.01)

(52) U.S. Cl. ..... 297/284.3; 297/353; 297/410

(58) Field of Classification Search ..... 297/61, 297/391, 396, 410, 216.12, 408, 409, 284.3, 297/353

See application file for complete search history.

(56) References Cited

U.S. PATENT DOCUMENTS 2,796,917 A * 6/1957 Luckhardt ..... 297/410 X
2,796,918 A * 6/1957 Luckhardt ..... 297/410 X
2,989,341 A 6/1961 Schliephacke
3,033,610 A 6/1962 Fletcher
3,051,965 A 9/1962 Szemplak
3,104,912 A * 9/1963 Schliephacke ..... 297/61
3,132,894 A * 5/1964 Schliephacke ..... 297/61
3,140,117 A * 7/1964 Fletcher ..... 297/61
3,554,599 A * 1/1971 Pietschmann ..... 297/284.3 X
4,765,683 A * 8/1988 Hattori ..... 297/410
5,120,109 A * 6/1992 Rangoni ..... 297/284.3
5,346,283 A * 9/1994 Steininger et al. ..... 297/408
5,681,088 A 10/1997 Takei
5,836,647 A * 11/1998 Turman ..... 297/284.3 X
5,927,804 A * 7/1999 Cuevas ..... 297/216.12
6,045,181 A 4/2000 Ikeda
6,179,379 B1 * 1/2001 Andersson ..... 297/216.13

FOREIGN PATENT DOCUMENTS

DE 9011775 11/1990
EP 197170 4/2002

* cited by examiner

*Primary Examiner*—Rodney B. White
*Assistant Examiner*—Stephen Vu
(74) *Attorney, Agent, or Firm*—Andrew Wilford

(57) ABSTRACT

A piece of furniture has a seat back having a front face and a headrest having a front face and positioned above the seat back with the front faces both facing forward. A guide forces displacement of the headrest relative to the seat back in a continuous and synchronous tipping/sliding movement between a lower position with the headrest relatively closely juxtaposed with the seat back and with the front faces generally parallel and an upper position with the headrest spaced above the seat back and the front faces forming a large acute angle. An upholstery cover is stretched as a single piece over the front faces of the headrest and the seat back.

6 Claims, 4 Drawing Sheets

SEAT BACK WITH ADJUSTABLE HEADREST

FIELD OF THE INVENTION

The present invention relates to a seat back with a headrest. More particularly this invention concerns such a seat back whose headrest is vertically adjustable.

BACKGROUND OF THE INVENTION

It is standard to provide a seat back with a headrest that can be vertically raised and lowered, and that can also be tipped, that is rotated or pivoted about a horizontal axis. Such a headrest is provided in a motor-vehicle seat, for example. See U.S. Pat. Nos. 5,681,088 and 6,045,181.

When, however, a tippable seat back is used in a piece of furniture having upholstery or a cover that extends over both the seat back and the headrest, and where the headrest forms in the lower position a straight continuation of the seat back, the result is normally unsatisfactory. As the headrest tips forward, the upholstery crumples or folds together at the front, since the straight-line distance from the front top edge of the headrest to the front bottom edge of the seat back decreases. This is not only unattractive, but can create a bump that makes the headrest uncomfortable to use.

OBJECTS OF THE INVENTION

It is therefore an object of the present invention to provide an improved seat back.

Another object is the provision of such an improved seat back which overcomes the above-given disadvantages, that is which has a headrest that can tip forward without crumpling the upholstery.

SUMMARY OF THE INVENTION

A piece of furniture has according to the invention a seat back having a front face and a headrest having a front face and positioned above the seat back with the front faces both facing forward. A guide forces displacement of the headrest relative to the seat back in a continuous and synchronous tipping/sliding movement between a lower position with the headrest relatively closely juxtaposed with the seat back and with the front faces generally parallel and an upper position with the headrest spaced above the seat back and the front faces forming a large acute angle. The tipping movement is synchronous with and in fact a function of the vertical movement. An upholstery cover is stretched as a single piece over the front faces of the headrest and the seat back.

Thus with the system of this invention the forward tipping of the headrest, which normally would in effect shorten the straight-line distance followed by the cover between the upper edge of the headrest and the lower edge of the seat back, is compensated for by upward displacement of the headrest. As a result the cover stays taut and no wrinkles or crumpling take place in the front cover.

According to the invention the headrest has a lower end juxtaposed with an upper end of the seat back and the guide has according to the invention a plate having an arcuate track on one of the ends, and a pair of vertically spaced followers on the other of the ends riding in the track. This mechanism synchronizes the tipping movement with the vertical displacement. The track according to the invention is an arcuate groove and the followers are pins engaged in the groove. The arcuate guide has a center of curvature forward of the front faces. Normally the head part tips through less than 20° on movement between the upper and lower positions.

In accordance with a further feature of the invention a motor and a linkage are connected between the seat part and the headrest for moving the headrest between the upper and lower positions. When the seat back is tippable about a horizontal axis on the piece of furniture a linkage is connected between the motor and the piece of furniture for tipping of the seat back about the horizontal axis on movement of the headrest between the upper and lower positions.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
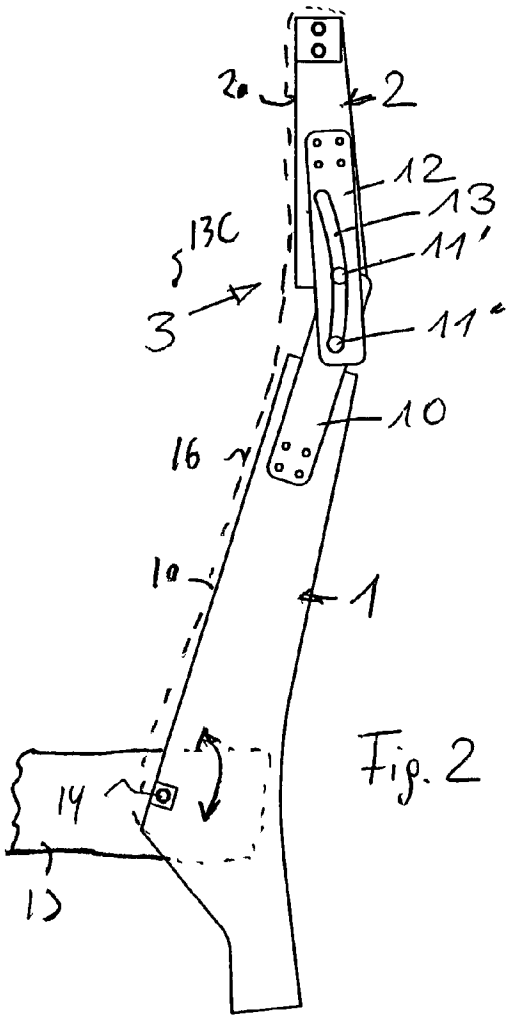
FIGS. 1 and 2 are front and side views of a seat back with a headrest is the raised or upper position.

As seen in FIGS. 1–4, a piece of furniture shown partly at 17 in FIG. 2 has a seat back 1 with a generally planar front face 1*a* and, above an upper end of the back 1, a headrest 2 having a generally planar front face 2*a*. The back 1 can rock or pivot about a horizontal axis 14 on the furniture 17 between the slightly reclining position seen in FIG. 2 and the upright position of FIG. 4. The back 1 and headrest 2 are upholstered and a common stretchable fabric cover 16 extends over both of them. The headrest 2 is carried via a pair of mounts 3 on the seat back 1 so that it can move between an upper position shown in FIGS. 1 and 2 in which the headrest 2 is spaced above the upper end of the seat back 1 and the planes 1*a* and 1*b* form an obtuse angle greater than 160° with each other and a lower position shown in FIGS. 3 and 4 in which the headrest 2 sits directly on the upper end of the seat back 1 and the planes 1*a* and 2*a* are coplanar.

The mounts 3 are identical and each have a plate 10 fixed to a respective side of the upper end of the seat back 1 and carrying a pair of vertically spaced guide pins 11' and 11" defining a pair of parallel and vertically spaced axes 11A' and 11A". These pins 11' and 11" glide in an arcuate guide slot or groove 13 formed in an upper plate 12 fixed to a respective side of the lower end of the headrest 2. The groove 13 is circularly arcuate and has a center of curvature 13C lying forward of the planes 1*a* and 2*a*.

Figure 1:
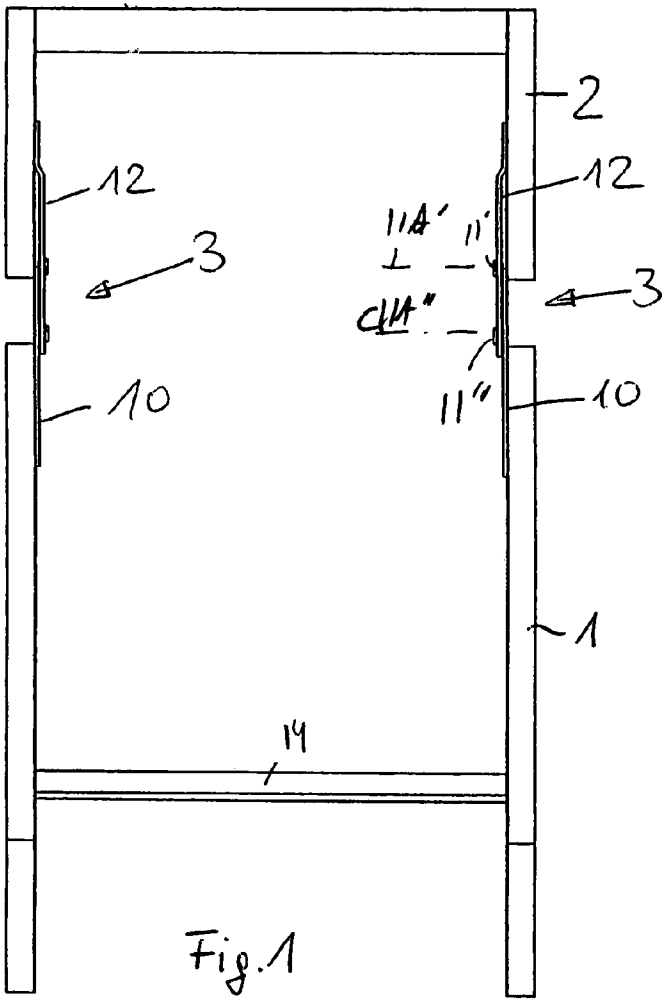
Figure 4:
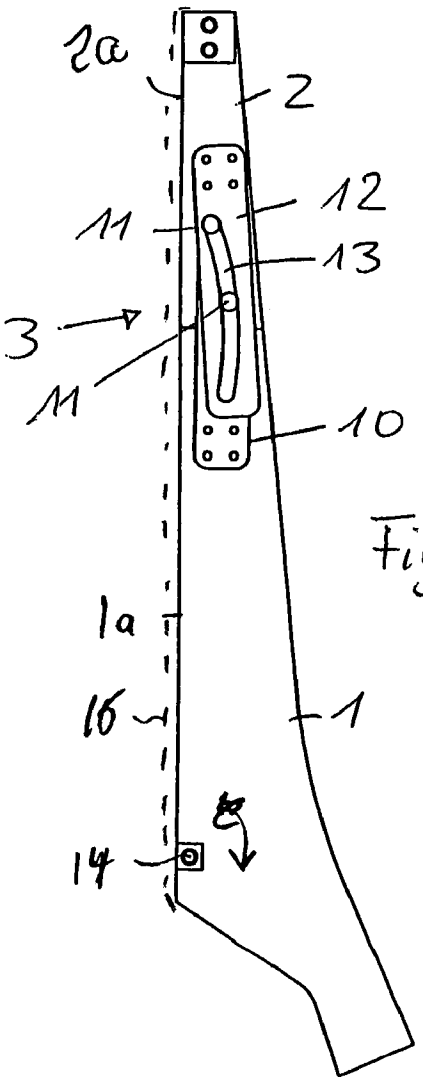
FIGS. 3 and 4 are views like respective FIGS. 1 and 2, but with the headrest in the lower position.
Figure 3:
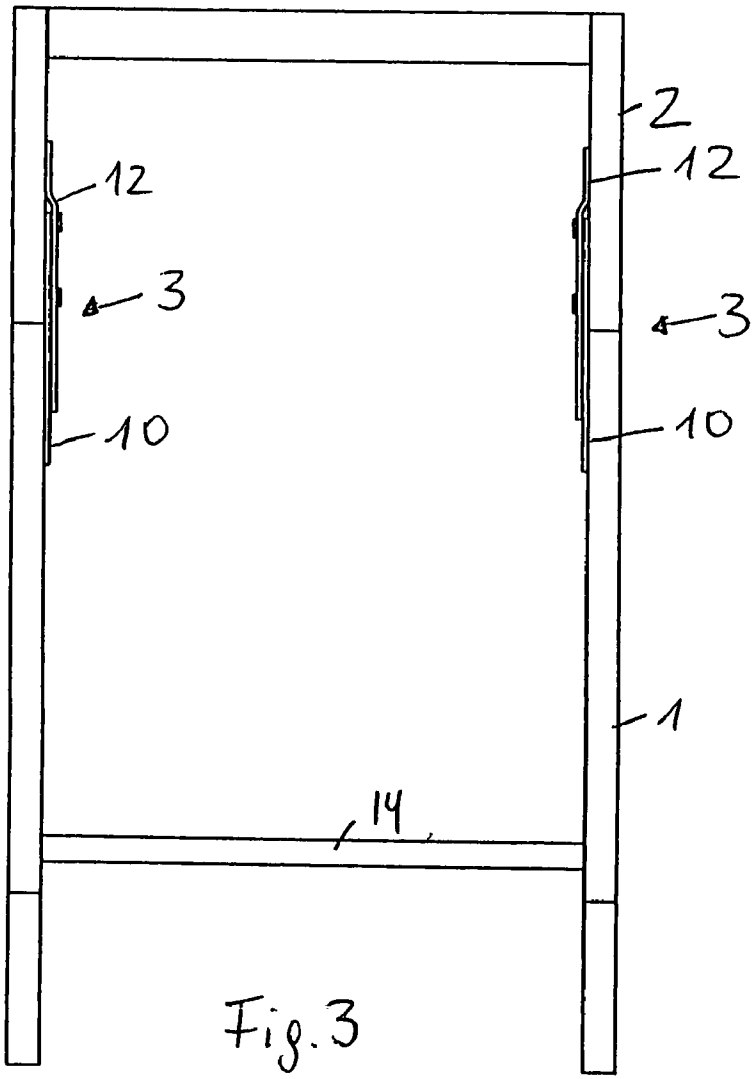

Thus, as the headrest 2 is dropped from the upper position of FIGS. 1 and 2 to the lower position of FIGS. 3 and 4, it will be forced to move from the reclining position of FIGS. 1 and 2 with the plane 2*a* of the headrest 2 forming the above-described obtuse angle with the plane 1*a* of the back 1 to the erect position of FIGS. 3 and 4 with the planes 1*a* and 2*a* coplanar. On reverse movement, as the headrest 2 moves upward, it also is forced to tilt forward. Thus the loss of effective distance between the top edge of the headrest 2 and the bottom edge of the seat back 1 is compensated for by the upward movement so that the cover 16 will remain taut.

Figure 6:
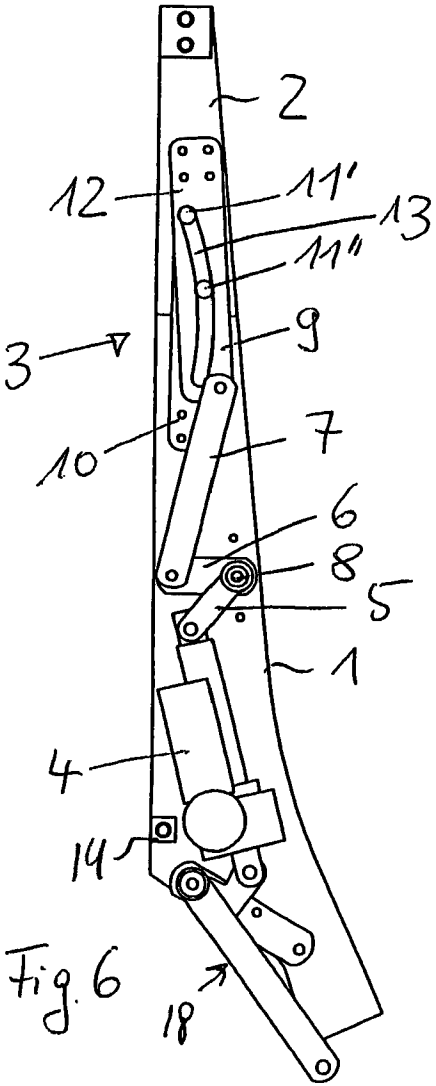
FIGS. 5 and 6 are views like respective FIGS. 2 and 3 of another seat back in accordance with the invention.
Figure 5:
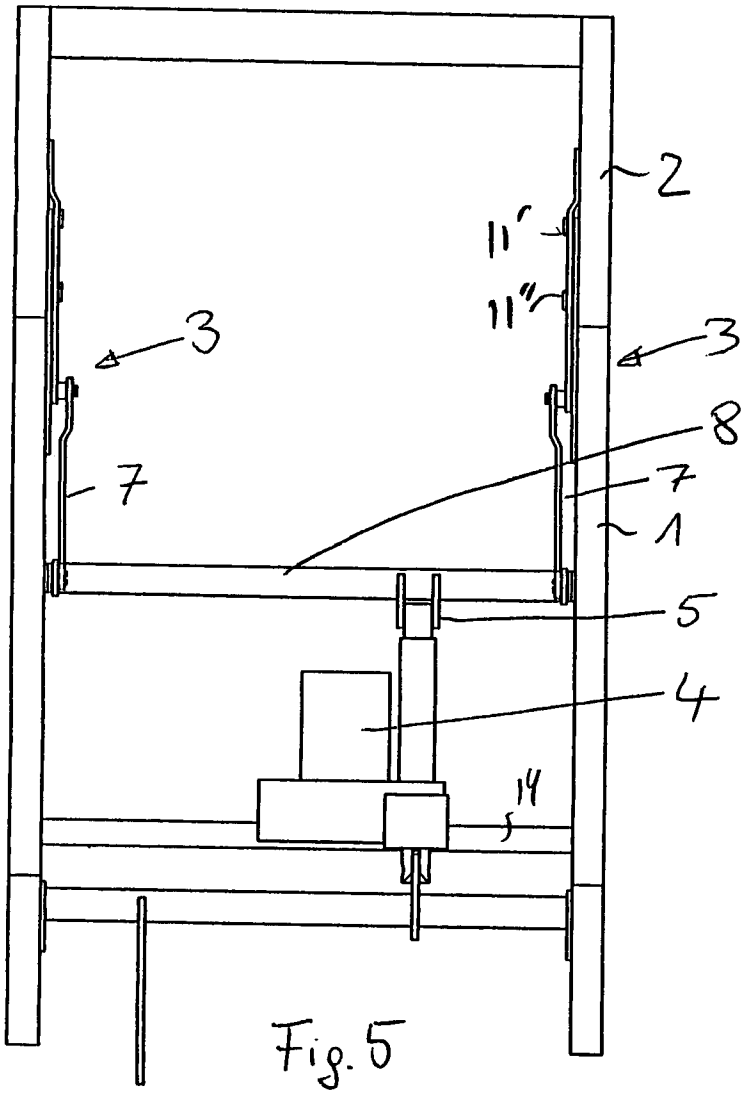
Figure 8:
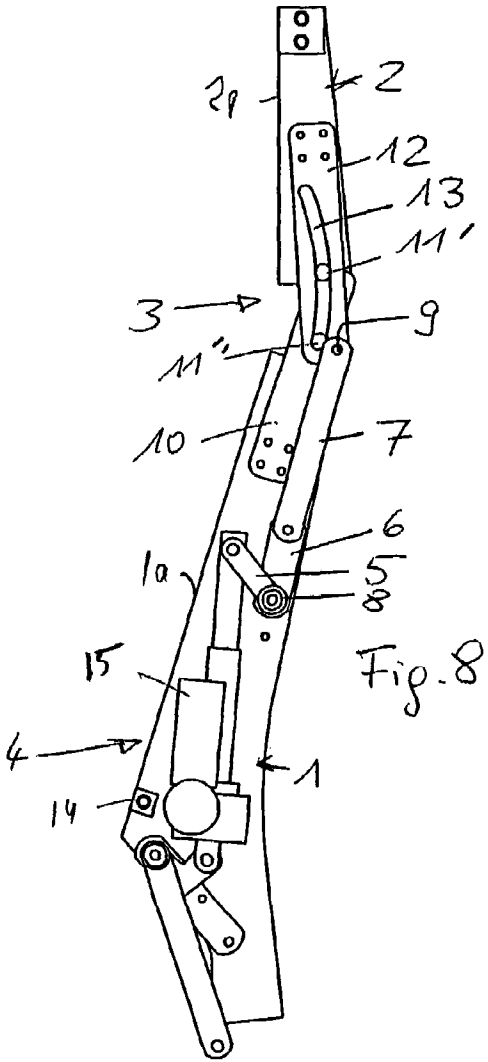
FIGS. 7 and 8 are views like respective FIGS. 1 and 2 of the seat back of FIGS. 5 and 6.
Figure 7:
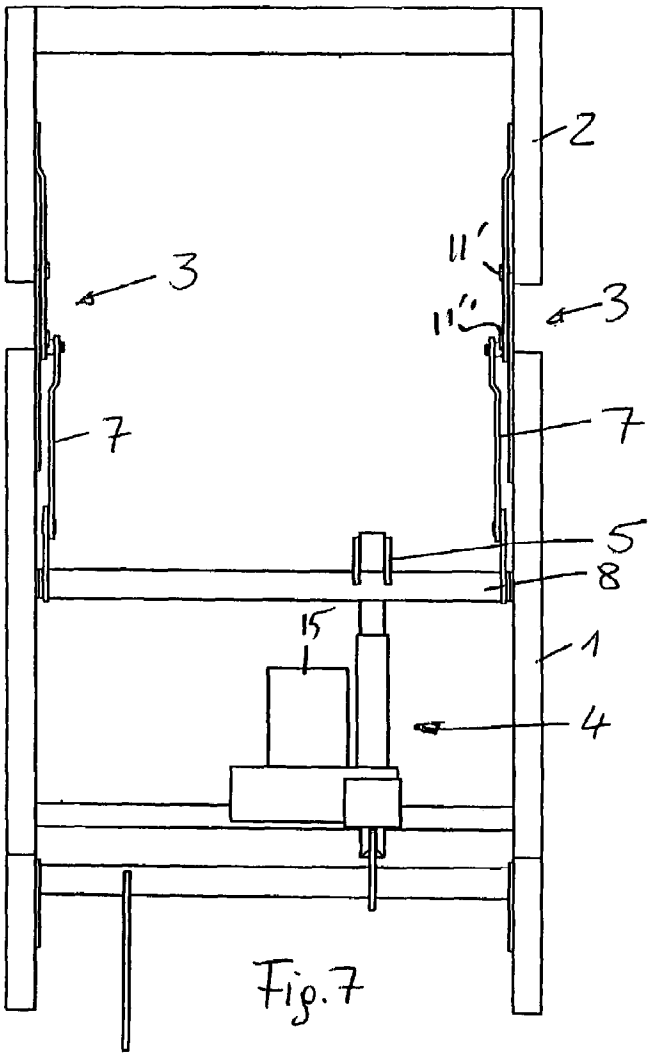

FIGS. 5–7 show the same structure as FIGS. 1–4, except that a drive motor 15 is provided to effect both the synchronous coupled movement between the upper and lower positions and the forward and backward rocking of the seat back about the axis 14. To this end the drive motor 15 can pivot a first lever 5 connected to a shaft 8 from which extend two arms or levers 7 coupled to the lower ends of rigid links 7 having upper ends pivoted at 9 on the lower ends of the plates 12 of the headrest 2. In addition the motor 4 is connected via a linkage 18 to the furniture 17 so that movement of the headrest 2 from the lower to the upper position is coupled to rocking back of the seat back 1 from an erect to a reclined position and vice versa.

We claim:

1. A piece of furniture comprising:

a seat back having a front face and an upper end;

a headrest having a front face and an upper end and positioned above the seat back with the front faces both facing forward and the upper and lower ends juxtaposed; and means including a plate having an arcuate groove on the lower end of the headrest and a pair of vertically spaced follower pins on the upper end of the seat back, both pins being engaged in the groove for displacement of the headrest relative to the seat back in a continuous and synchronous tipping/sliding movement between a lower position with the headrest relatively closely juxtaposed with the seat back and with the front faces generally parallel and an upper position with the headrest spaced above the seat back and the front faces forming a large acute angle, the arcuate guide having a center of curvature forward of the front faces.

2. The piece of furniture defined in claim 1, further comprising:

an upholstery cover stretched as a single piece over the front faces of the headrest and the seat back.

3. The piece of furniture defined in claim 1 wherein the head part tips through less than 20° on movement between the upper and lower positions.

4. The piece of furniture defined in claim 1, further comprising:

means including a motor and a linkage connected between the seat part and the headrest for moving the headrest between the upper and lower positions.

5. The piece of furniture defined in claim 4 wherein the seat back is tippable about a horizontal axis on the piece of furniture.

6. The piece of furniture defined in claim 5, further comprising a linkage connected between the motor and the piece of furniture for tipping of the seat about the horizontal axis on movement of the headrest between the upper and lower positions.

* * * * *